US005870121A

United States Patent [19]

Chan

[11] Patent Number: 5,870,121

[45] Date of Patent: Feb. 9, 1999

[54] TI/TITANIUM NITRIDE AND TI/TUNGSTEN NITRIDE THIN FILM RESISTORS FOR THERMAL INK JET TECHNOLOGY

[75] Inventor: Lap Chan, San Francisco, Calif.

[73] Assignee: Chartered Semiconductor Manufacturing, Ltd., Singapore, Singapore

[21] Appl. No.: 947,829

[22] Filed: Oct. 8, 1997

Related U.S. Application Data

[62] Division of Ser. No. 745,637, Nov. 8, 1996, Pat. No. 5,710,070.

[51] Int. Cl.[6] ..... B41J 2/05

[52] U.S. Cl. ..... 347/59; 347/62

[58] Field of Search ..... 347/59, 62, 63, 347/64

[56] References Cited

U.S. PATENT DOCUMENTS

| | | | |
|---|---|---|---|
| 4,535,343 | 8/1985 | Wright | 347/64 |
| 4,789,425 | 12/1988 | Drake et al. | 156/644 |
| 4,922,269 | 5/1990 | Ikeda | 347/58 X |
| 5,122,812 | 6/1992 | Hess | 347/59 |
| 5,206,659 | 4/1993 | Sakurai | 347/62 |
| 5,368,683 | 11/1994 | Altravela et al. | 156/633 |
| 5,384,442 | 1/1995 | Danner | 200/566 |
| 5,387,314 | 2/1995 | Baughman et al. | 156/643 |
| 5,420,063 | 5/1995 | Maghsoudnia et al. | 437/60 |
| 5,439,554 | 8/1995 | Tamura et al. | 216/16 |
| 5,496,762 | 3/1996 | Sandhu et al. | 437/60 |
| 5,548,894 | 8/1996 | Muto | 347/47 X |

FOREIGN PATENT DOCUMENTS

| | | | |
|---|---|---|---|
| 1-235664 | 9/1989 | Japan | B41J 3/20 |

*Primary Examiner*—Joseph Hartary
*Attorney, Agent, or Firm*—George O. Saile; Stephen B. Ackerman; William J. Stoffel

[57] ABSTRACT

The present invention provides a structure and a method of manufacturing a resistor in a semiconductor device and especially for a resistor in an ink jet print head. The method begins by providing a substrate 10 having a field oxide region 20 surrounding an active area. The field oxide region 20 has an ink well region 52. Also a transistor is provided in the active area. The transistor comprises a source 12, drain 14 and gate electrode 16 18 19. A dielectric layer 24 is formed over the field oxide region 20 and the transistor 12 14 16 18. The dielectric layer 24 has contact openings over the source 12 and drain 14. A resistive layer 26 27 is formed over the dielectric layer 24 and contacting the source 12 and drain 14. The resistive layer 26 27 is preferably comprised of two layers of: a Titanium layer 26 under a titanium nitride 27 or a titanium layer 26 under a tungsten nitride layer 27. A first metal layer 28 is formed over the resistive layer. The metal layer 28 is patterned forming an first opening 29 over a portion of the resistive layer 28 over the ink well region 52. The resistive layer and first metal layer are patterned forming a second opening 31 over the gate electrode 16 18 and forming the resistive layer and first metal layer into an interconnect layer. A passivation layer 30 is then formed over the first metal layer 28, the resistive layer 26 27 in the ink well region 52, and the gate electrode 16 18.

12 Claims, 3 Drawing Sheets

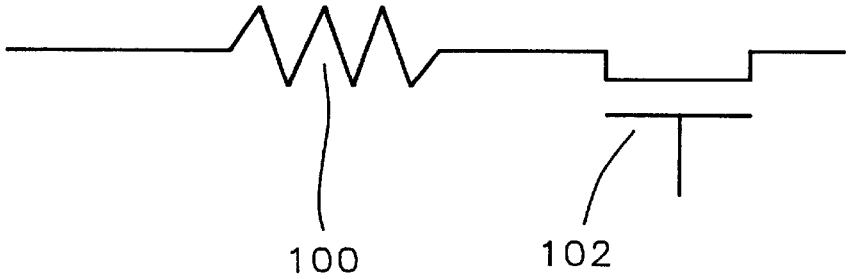
FIG. 1 – Prior Art
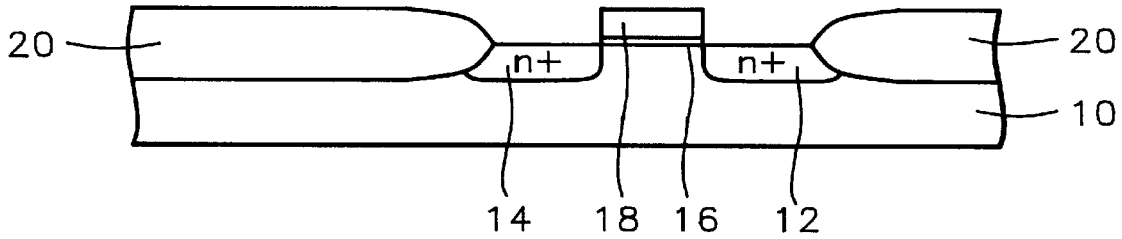
FIG. 2
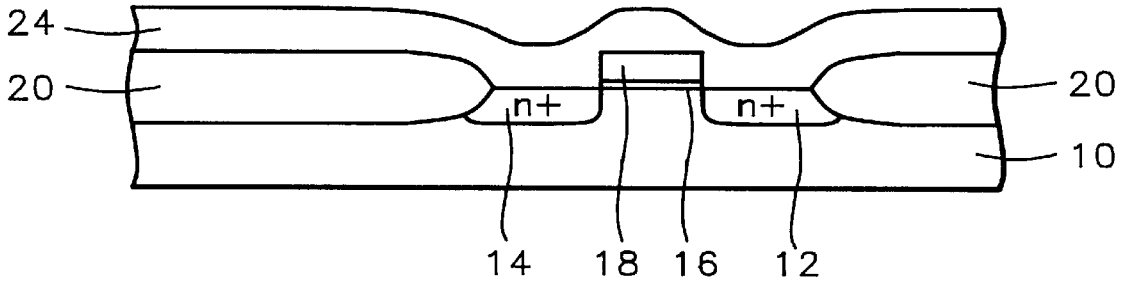
FIG. 3

TI/TITANIUM NITRIDE AND TI/TUNGSTEN NITRIDE THIN FILM RESISTORS FOR THERMAL INK JET TECHNOLOGY

This patent resulted from a divisional patent application from Ser. No. 08/745,637 filed: Nov. 8, 1996, now U.S. Pat. No. 5,710,070, issued: Jan. 20, 1998; entitled "Application Of Titanium Nitride And Tungsten Nitride Thin Film Resistor For Thermal Ink Jet Technology".

BACKGROUND OF INVENTION

1). Field of the Invention

This invention relates generally to the structure and fabrication of resistors in an integrated circuit and more particularly to resistors in a thermal ink jet printing head.

2). Description of the Prior Art

Ink jet printing systems can be divided into two basic types. One type uses a piezoelectric transducer to produce a pressure pulse that expels a droplet from a nozzle. The other type uses thermal energy to produce a vapor bubble in an ink filled channel that expels a droplet. This latter type is referred to as thermal ink jet printing or bubble jet printing. Generally, thermal ink jet printing systems have a print head comprising one or more ink filled channels that communicate with a relatively small ink supply chamber at one end, and have an opening at the opposite end, referred to as a nozzle. A thermal energy generator, usually a resistor, is located in the channels near the nozzle at a predetermined distance upstream therefrom. The resistors are individually addressed with a current pulse representative of data signals to momentarily vaporize the ink and formed a bubble which expels an ink droplet. FIG. 1 shows an electrical schematic of one ink jet of a printhead having a resistor 100 and a power transistor 102. In fabrication, the ink supply chamber is located over the resistor and the power transistor is formed nearby on a substrate. One preferred method of fabricating thermal ink jet printheads is to form the heating elements on the surface of one silicon wafer and the channels and small ink supply chamber of reservoir on the surface of another silicon wafer.

In many integrated circuit applications, especially ink jet printheads, there is a need for structures which function as resistors. For years, widely doped silicon stripes have been used as resistors for a wide variety of applications. Most semiconductor manufacturers have abandoned this particular use of polysilicon resistors for several reasons. One reason is junction spiking. Not only is the resistivity of the polysilicon non-linear with respect to voltage, but it is difficult to achieve resistive values consistently in such structures due to three variables: deposit related polysilicon film thickness, etch dependent film width, and uniform doping levels. The three variables interact to establish the resistive value of the structure (resistor). Because the variability is too great, many manufacturers utilize a metal layer or a combination polysilicon and metal to create a mult-level resistor structures.

A major problem in the manufacture of thermal ink jet printhead is the resistor and power transistor quality and yields. FIG. 1 shows a resistor 100 connected to a power transistor 102. The resistor must be made of a material that has a controllable resistivity.

Many practitioners have improved the resistors and printheads. The most pertinent are as follows: U.S. Pat. No. 4,789,425 (Drake), U.S. Pat. No. 5,384,442 (Danner), U.S. Pat. No. 5,429,554 (Tunura), U.S. Pat. No. 5,387,314 (Baughman et al.) and U.S. Pat. No. 5,368,683 (Altavela) show the FAB methods and resulting structures of ink filled head with heater resistor. U.S. Pat. No. 5,496,762 (Sandhu) shows the use of a TiNC resistor. U.S. Pat. No. 5,420,063 (Mayhsoudnia) used a resistor layer of SiCr, NICr, TaN, CiCR plus a conductive layer of TiN as a resistive layer. However, printheads and resistors can be further improved to make them more reliable, especially at higher temperatures and less complicated to manufacture.

SUMMARY OF THE INVENTION

It is an object of the present invention to provide a structure and method for fabricating a semiconductor device having a resistive layer that has stable resistor properties and has excellent metal barrier layer properties.

It is another object of the present invention to provide a structure and a method of fabricating a thermal ink jet printhead comprising a resistive layer composed of titanium nitride or tungsten nitride which forms a resistor and a contact metal barrier layer.

It is still another object of the present invention to provide a structure and a method of fabricating a thermal ink jet printhead comprised of a resistive layer composed of Titanium/titanium nitride and Titanium/tungsten nitride where the resistive layer forms a heating resistor and a contact metal barrier layer for a power transistor.

To accomplish the above objectives, the present invention provides a method of manufacturing an ink jet printhead having an improved resistive layer that acts as a resistor and as a barrier for contact metallization. The method begins by providing a substrate 10 having a field oxide region 20 and a transistor in the active area. Next a dielectric layer 24 is formed over the field oxide region 20 and the transistor 12, 14, 16, 18. Contact openings are then formed in the dielectric layer 24 over the source 12 and drain 14.

Next, a resistive layer 26 27 is formed over the dielectric layer 24 and contacting the source 12 and drain 14. The resistive layer 26 27 is preferably of made two layers of Titanium/titanium nitride (Ti/TiN) or titanium/tungsten nitride ($Ti/WN_x$ where x is preferably between 0.3 and 0.5). A first metal layer 28 is formed over the resistive layer. The metal layer 28 is patterned forming an first opening 29 over a portion of the resistive layer 28 over the ink well region 52. The metal layer and the resistive layer are then patterned to form an interconnect layer. A passivation layer 30 is formed over the substrate. A second metal layer 36 is formed over the passivation layer 30 in the ink well region 52. A film 40 is formed over the substrate and an opening is etched over the ink well region (and resistor) to form an ink well. Lastly, a nozzle plate 42 having an orifice 50 is formed over the ink well 35.

In slightly more detail the invention comprises providing a substrate 10 having a field oxide region 20 surrounding an active area; the field oxide region 20 have an ink well region 52, and providing a transistor in the active area, the transistor comprising a source 12, drain 14 and gate electrode 16 18 19;

forming a dielectric layer 24 composed of phosphosilicate glass over the field oxide region 20 and the transistor 12 14 16 18, the dielectric layer 24 having contact openings over the source 12 and drain 14;

forming a resistive layer 26 over the dielectric layer 24 and contacting the source 12 and drain 14, the resistive layer 26 comprised of a two layer structure selected from the group consisting of: Titanium/titanium nitride and titanium/tungsten nitride;

forming a first metal layer 28 over the resistive layer; the first metal layer composed of aluminum;

patterning the first metal layer 28 composed of aluminum forming an first opening 29 over a portion of the resistive layer 28 over the ink well region 52 and a second opening 31 over the gate electrode 16 18 thereby exposing the resistive layer 26 over the gate electrode 16 18;

patterning the first metal layer 28 forming an first opening 29 over a portion of the resistive layer 28 over the ink well region 52;

patterning the first metal layer 28 and the resistive layer 26 27 forming a second opening 31 over the gate electrode 16 18 and patterning the first metal layer 28 and the resistive layer 26 27 forming a first interconnect layer;

forming a passivation layer 30 over the first metal layer 28, the resistive layer 26 27 in the ink well region 52 and the gate electrode 16 18; the passivation layer composed of a material selected from the group consisting of silicon oxide, silicon nitride and silicon oxynitride;

forming a second metal layer composed of tantalum over the passivation layer 30 in the ink well region 52;

forming a film 40 comprising silicon oxide over the substrate, the film 40 having an opening over the ink well region thereby forming an ink well 44, the ink well exposing the second metal layer 35;

forming a nozzle plate 42 over the film 40, the nozzle plate comprised of silicon carbide having an orifice 50 in communication with the ink well 35.

The invention provides an ink jet printhead that has an improved resistive layer is preferably composed of titanium/titanium nitride or titanium/tungsten nitride. The resistive layer is used as the heating resistor in the inkwell and as a contact metal barrier layer for the first level metal for the power transistor. The titanium/titanium nitride or titanium/tungsten nitride layer of the invention provides better electro-migration performance (i.e., lifetime) to sustain high current density at high temperature stress. This is important particularly at the corners were the first metal layer (Al) layer meets the resistive (TiN or WNx where x is preferably between 0.3 and 0.5) layer. This resistive layer 26 27 also acts as an excellent junction barrier for MOS devices. Moreover, the invention's chemical vapor deposition process used to form the resistive layer is applicable to future generations of ink jet printhead without any process changes.

The invention's chemical vapor deposition (CVD) to form resistive film process provides better step coverage at the contact. Also, both Ti/TiN and Ti/WN resistive layer are able to withstand high temperature backend processes (e.g., greater than 400° C.).

BRIEF DESCRIPTION OF THE DRAWINGS

The features and advantages of a semiconductor device according to the present invention and further details of a process of fabricating such a semiconductor device in accordance with the present invention will be more clearly understood from the following description taken in conjunction with the accompanying drawings in which like reference numerals designate similar or corresponding elements, regions and portions and in which:

FIG. 1 shows a schematic drawing of a circuit for an ink jet printhead according to the prior art.

FIGS. 2 through 7 are a cross sectional views for illustrating a structure and a method for manufacturing the ink jet printhead according to the present invention.

DETAILED DESCRIPTION OF THE PREFERRED EMBODIMENTS

The present invention will be described in detail with reference to the accompanying drawings. The present invention provides a method of forming an ink jet printhead having an improved resistive layer 26 27. The resistive layer acts as a resistor and as a barrier for first level metallization for MOS devices on the substrate. It should be will understood by one skilled in the art that by including additional process step not described in this embodiment, other types of devices can also be included on the substrate. It should also be understood that the figures depict only one ink jet well and transistor out of a multitude that are fabricated simultaneously. Also, the resistive layer can be used in other circuit and chip types in addition to ink jet printhead chips.

Figure 7:
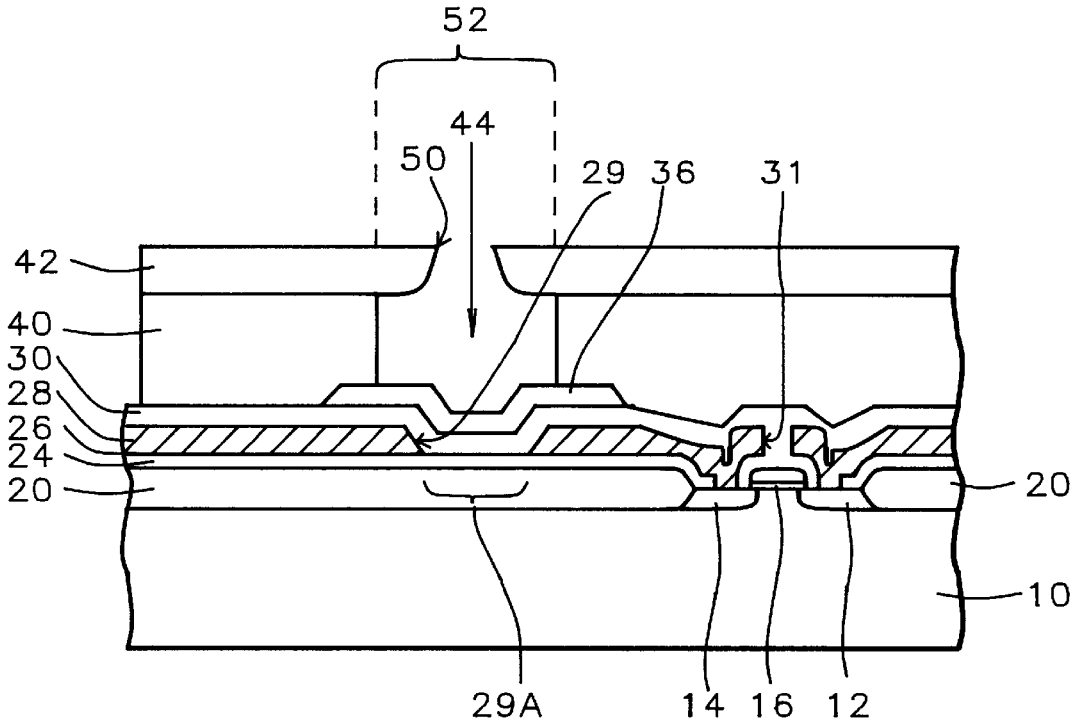

As shown in FIGS. 2 and 7, a substrate 10 is provided having a field oxide region 20 surrounding an active area. Substrate 10 is understood to possibly include a semiconductor wafer, active and passive devices formed within the wafer and layers formed on the wafer surface. The term "substrate" is mean to include devices formed within a semiconductor wafer and the layers overlying the wafer. The term "substrate surface" is meant to include the upper most exposed layers on a semiconductor wafer, such as a silicon surface, an insulating layer and metallurgy lines.

One method of forming the field oxide regions is describe by E. Kooi in U.S. Pat. No. 3,970,486, wherein selected surface portions of a silicon substrate are masked against oxidation and the unmasked surface is oxidized to grow a thermal oxide which in effect sinks into the silicon surface at the unmasked areas. The mask is removed and semiconductor devices can be formed in the openings between the isolation regions. The field oxide regions preferably a thickness in a range of between about 5000 and 15,000 Å. A very thick field oxide will limit the thermal conductivity to the substrate.

Several areas are defined over the substrate for descriptive purposes. As shown in FIGS. 2 and 7, an ink well region 52 is defined above a portion of the field oxide where an well (ink supply reservoir) will be formed. A transistor is formed over the active area. The transistor can be called a power transistor because it supplies the power to the heating resistor 29A. The transistor comprises a source 12, drain 14 and gate electrode 16 18 19. The transistor is preferably a MOS FET device (e.g., metal oxide semiconductor field effect transistor). Because of the thick field oxide, high device threshold (>2.0 V) and high threshold (>20 V) can be achieved.

As shown in FIG. 3, a dielectric layer 24 is formed over the field oxide region 20 and the transistor 12 14 16 18. The dielectric layer 24 has contact openings over at least the source 12 and drain 14. The contact opening can be formed by conventional photolithographic and dry etching processes. The dielectric layer 24 is preferably composed of a doped oxide, such as phosphosilicate glass (PSG) or boron phosphosilicate glass (BPSG). The dielectric preferably has a thickness in a range of between about 5000 and 15,000 Å.

Figure 4:
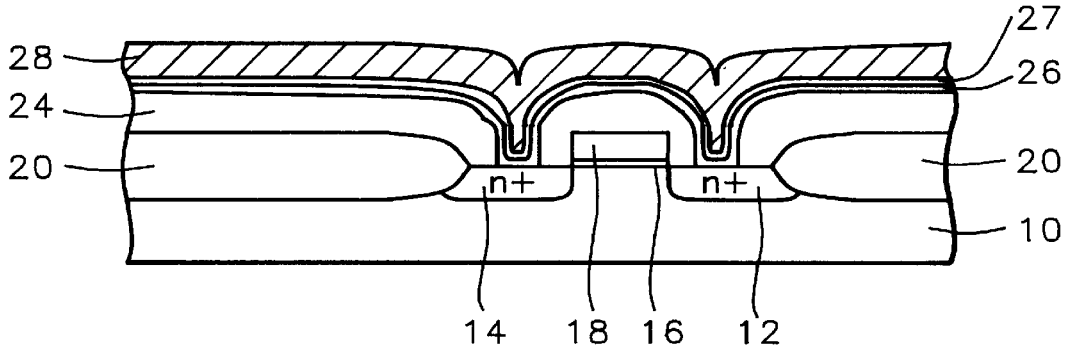

Referring to FIG. 4, a resistive layer 26, 27 is then formed over the dielectric layer 24 and contacting the source 12 and drain 14. The resistive layer 26 27 is preferably comprised of a 2 layer structure of titanium 26/titanium nitride 27 or titanium 26/tungsten nitride 27. The bottom titanium layer 26 is preferably formed by a sputtering process. The top TiN or TW layer 27 can be formed with a CVD or a sputter process. The processes of the invention used to form the resistive layer are described below: (1) CVD TiN layer using Ti $[N(C_2H_5)_2]_4$ (2) CVD TiN layer using $Ti[N(CH_3)_2]_4$ (3) CVD TiN layer using $TiCl_4$ and (4) TiN layer 26 by a sputter process (5) Titanium/tungsten nitride (Ti/WNx) using CVD or PFCVD. The resistive layer is more preferably formed of Ti/TiN using a sputter process.

Figure 8:
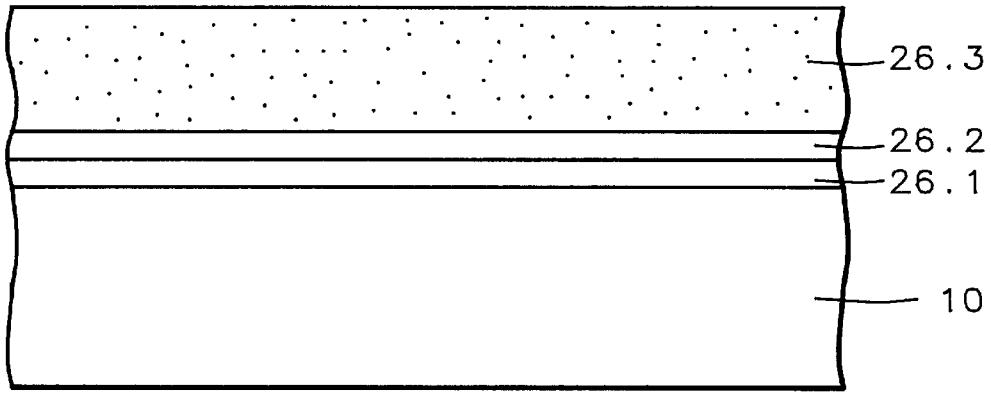
FIG. 8 shows a resistive layer formed by stuffing the layer with oxygen.

Resistive Ti/TiN layer 26 27 by CVD processes—The resistive layer 26 27 composed of Titanium/titanium nitride is preferably formed by sputtering the bottom Titanium layer 26 and depositing the TiN layer 27 via a chemical vapor deposition (i.e., PECVD) by pyrolyzing $TiCl_4$ or an organometalic precursor compound of the formula $Ti(NR_2)_4$ (wherein R is an alkyl group) either alone or in the presence of either a nitrogen source (e.g., ammonia or nitrogen gas) obtain Predominately amorphous TiN films demonstrate highly stable, high reliable resistive obtain characteristics with bulk resistivity values between 100 to 1000 micro-ohm range. To obtain better barrier properties, the films can be stuffed with oxygen or nitrogen by rapid thermal annealing (RTA) or furnace annealing. After the anneal the layer 26 27 has the following structure shown in FIG. 8: Si(10)/TiSi2 (26.1)/TiNO (26.2)/TiN (26.3). The lower Ti layer 26 reacts with the Silicon substrate to form $TiSi_2$ (26.1) over the contact (source and drain regions).

The preferred process variables for the CVD processes for the TiN layer 27 are shown below.

TABLE 1

TiN layer 27 - process description - $Ti[N(C_2H_5)]_4$ - CVD

| variable | units | low limit | target | hi limit |
|---|---|---|---|---|
| Temperature | °C. | 200 | 420 | 600 |
| Pressure | torr | 1 | 10 | 100 |
| Reactant gases $NH_3/Ti[N(C_2H_5)_2]_4$ | sccm | 10 | 30 | 200 |
| Ratio of Reactant gasses | $NH_3/Ti[N(C_2H_5)_2]_4$ | 2:1 | 1:2 | 1:10 |
| Carrier Gas flow: Argon | sccm | 1 | 10 | 50 |
| resistivity | μohm-cm | 50 | 200 | 800 |

TABLE 2

TiN layer 27 - process description - $Ti[(N(CH_3)_2]_4$ - CVD

| variable | units | low limit | target | hi limit |
|---|---|---|---|---|
| Temperature | °C. | 200 | 420 | 600 |
| Pressure | torr | 0.1 | 2 | 20 |
| Reactant gas $Ti[N(CH_3)_2]_4$ | | | | |
| Carrier Gas flow: $N_2$ | sccm | 150 | 250 | 500 |
| Carrier Gas flow: He | sccm | 100 | 150 | 300 |
| resistivity | μohm-cm | 50 | 200 | 1000 |
| Power of $H_2/N_2$ plasma treatment | RF watts | 50 | 200 | 500 |

TABLE 3

TiN layer 27 - process description - $TiCl_4$ - CVD

| variable | units | low limit | target | hi limit |
|---|---|---|---|---|
| Temperature | °C. | 400 | 600 | 800 |
| Pressure | mtorr | 50 | 150 | 1000 |
| Reactant gases $NH_3/Ti[N(C_2H_5)_2]_4$ | sccm | 2 | 150 | 600 |
| Ratio of Reactant gasses | $NH_3:TiCl_4$ | 1:1 | 10:1 | 30:1 |
| Carrier Gas flow: Argon | sccm | 1 | 5 | 20 |
| resistivity | μohm-cm | 50 | 200 | 600 |

After deposition, preferably an in-situ $H_2/N_2$ plasma treatment is performed to reduce the carbon content (i.e., to lower the sheet resistivity and to stabilize the film to minimize moisture absorption.

The TiN layer be also formed using $Ti(C_xN_y)$ or $Ti(NMe2)_4$. See U.S. Pat. No. 5,496,762 (Sandhu et al.).

The resistor/barrier layer formed using the metal organic CVD process for TiN has the advantages of a relatively low processing temperature (lower activation energy). Also the metal organic precursor is less corrosive to the environment (i.e., the chamber wall and susceptor), and has less particle contamination. However, $TiCl_4$ tends to have more particle contamination.

TiN layer 27 by Sputter process—Alternatively, a resistive layer 26 27 formed of Ti/TiN can be formed by a sputtering process. The resistive layer 26 composed of Ti/titanium nitride preferably has a Ti thickness in a range of between about 200 and 600 Å and a TiN layer thickness in a range of between about 400 and 2000 angstroms. The resistive layer 26 has a resistance in a range of about 20 and 50 ohms/sq.

The sheet resistance and the uniformity of the metal nitride layer (TiN and WN) can be accurately controlled by making small adjustments of the scan rate of the metal nitride layer.

Resistive layer 26 27-Ti/tungsten nitride-CVD—The resistive layer 26 27 can also be formed of Ti/Tungsten Nitride (WNx) using either a chemical vapor deposition (i.e., PECVD) or sputtering process. The bottom Ti layer 26 can be formed with a sputter process. A resistive layer of tungsten nitride (WNx) 27 can be formed by a chemical vapor deposition process using the process variables shown below in the table 4.

TABLE 4

CVD Tungsten Nitride layer 27 - process description

| variable | units | low limit | target | hi limit |
|---|---|---|---|---|
| Temperature | °C. | 100 | 400 | 600 |
| Pressure | torr | 0.1 | 10 | 100 |
| Reactant gasses | $NH_3/WF_6/H_2$ | | | |
| Ratio of Reactant gasses | $NH_3/WF_6$ | 1:5 | 1:1 | 5:1 |
| Carrier Gasses | He or $N_2$ | | | |
| resistivity | μohm-cm | | | |
| Power of $H_2/N_2$ plasma treatment | RF watts | 50 | 200 | 500 |

Overall, the most preferred method for forning the Ti/TiN or the Ti/TW layer 26 27 is using a sputtering process where the dimension is above 0.35 μm but chemical vapor deposition (CVD) methods are applicable down to below 0.25 μm. The Ti/TiN layer 26 27 is preferably sputtered at a pressure in a range of between about 0.1 and 10 torr and at a temperature in a range of between about 100° and 425° C. After deposition, the resistive layer 26 27 can be treated with a $N_2$ plasma to lower the sheet resistance of the CVD deposited TiN film.

As shown in FIG. 4, a metal layer 28 is formed over the resistive layer. The metal layer is preferably comprised of aluminum and is preferably formed of aluminum with 0.5 to 4.0% Cu to have better electromigration properties. The metal layer 28 preferably has a thickness in a range of between about 5000 and 15,000 Å.

Figure 5:
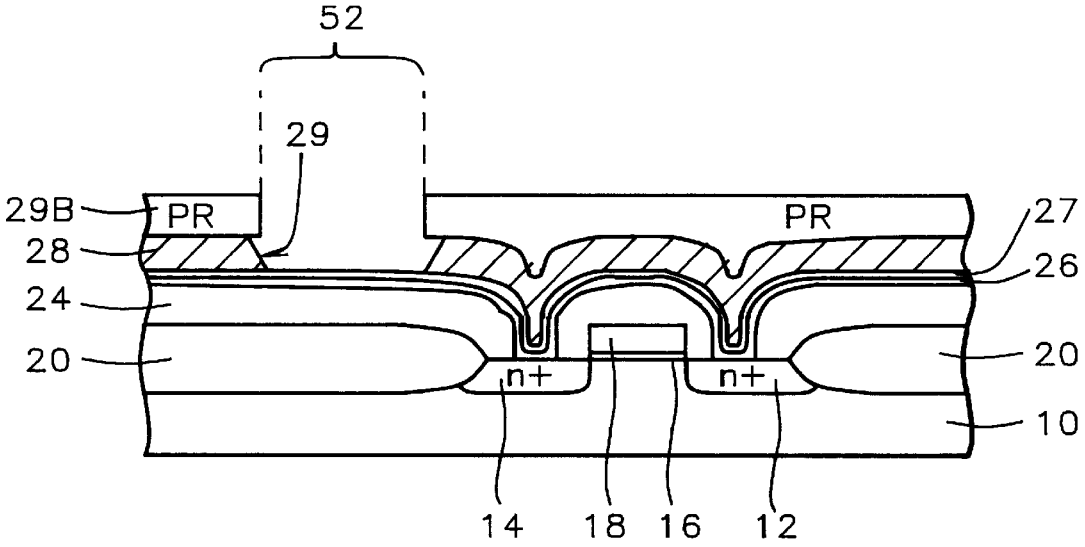

As shown in FIG. 5, the metal layer 28 is patterned to form an ink well opening 29 (e.g., first opening 29 over a portion of the resistive layer 28 over the ink well region 52). A photoresist layer 29B has an opening over the ink well area 52 is formed over the metal layer 28. Next, the metal layer 28 is etched through the photoresist 29B opening. The etch is preferably an isotropic etch, such as a wet etch. A preferred wet etch is a phosphoric acid and nitric acid/DI water etch ($H_3PO_4/HNO_3/H_2O$). The etch preferably creates an opening 29 with sloped sidewalls (see FIG. 5). The sloped (non-vertical) sidewalls are desirable because they reduce current density gradually across the slope.

Figure 6:
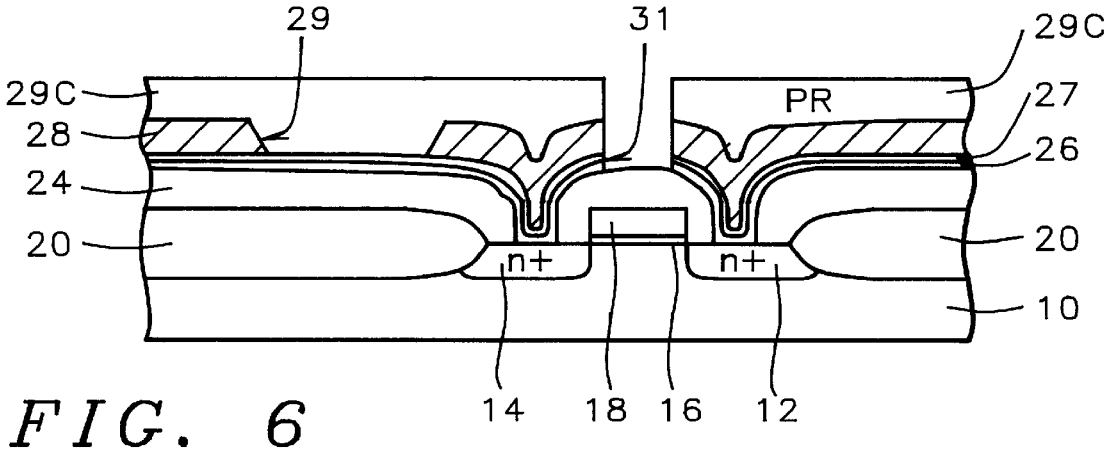

As shown in FIG. 6, the metal layer 28 and the resistive layer 26 27 are then patterned thereby forming a second opening 31 over the gate electrode 16 18 and thereby patterning the layers 26 27 and 28 into a first metal interconnect layer 26 27 28. A photoresist layer 29C is used as shown in FIG. 6. This electrically isolates the source and drains. This patterning also defines the first metal layer 28. The metal layer 28 and the resistive layer 26 27 are preferably etched with $CCl_4$, $CCl_4+Cl_2$, $BCl_3$, $BCl_3+Cl_2$ or $HCl+Cl_2$.

The resistor 29A preferably has an area in the range of about 50 and 200 square μm. The resistive layer and metal layers will remain on the source and drain regions 12 14 to act as a barrier layer. The resistive layer is removed between all areas where electrical connections are not desired.

As shown in FIG. 7, a passivation layer 30 is then formed over the metal layer 28, the gate electrode 16 18, and resistive layer 26 in the ink well region 52. The passivation layer 30 can be formed of silicon oxide, silicon nitride, silicon oxynitride or a combination of silicon oxide/silicon nitride stack. The passivation layer 30 preferably has a thickness in a range of about 5000 Å and 20,000 Å. The passivation layer must be able to withstand high temperatures stress since each individual ink will be firing at a frequency of about 10 to 20 kHz. The passivation layer must be reliable under these stresses over the lifetime of the device.

Still referring to FIG. 7, a second metal layer 36 is formed over the passivation layer 30 in the ink well region 52. The second metal layer can be formed of tantalum, tantalum nitride, titanium nitride, or tungsten nitride, and more preferably is formed of tungsten nitride. The second metal layer preferably has a thickness in a range of between about 5000 and 20,000 Å. The function of the second metal layer 36 is as a high heat conductor and thermal shock absorber to vaporize the ink in side the ink well. The second metal layer must be able to withstand thermal stress (>400° C.) and be able to withstand corrosive ink. The resides of the ink induce corrosion.

Following this, a film 40 is formed over the substrate. The film 40 is used to define the ink well 44. The film 40 is preferably composed of silicon carbide or tantalum carbide. The film preferably has a thickness in a range of about 4 to 20 μm. The film 40 is patterned to form an opening 44 over the ink well region 52 thereby forming an ink well 44 (e.g., a cavity). The ink well exposes the second metal layer 36. The inkwell preferably has an area in the range of 14 to 30 sq-μm and a volume in a range of between about 2000 and 20,000 $\mu m^3$.

A nozzle plate 42 having an orifice 50 (e.g., opening) is formed in communication with the ink well 35. The nozzle plate 42 is preferably formed of metal or metal nitride films. The nozzle plate preferably has a thickness in a range of between about 1 and 5 μm.

The invention provides an ink jet printhead that has an improved resistive layer composed of two layers of titanium/titanium nitride or titanium/tungsten nitride. The resistive layer is used as a resistor in the inkwell and as a contact metal barrier layer for the first level metal. The titanium/titanium nitride or titanium/tungsten nitride layer of the invention provides better electromigration performance (i.e., lifetime) at high temperature stress. The resistive layer also acts as an excellent junction barrier for MOS devices. Moreover, the chemical vapor deposition process to form the resistive layer is applicable to future generations of ink jet printhead without any process changes.

This invention relates to integrated circuits and, more particularly, to the structure and function of resistor structures in such circuits. The resistor and structures disclosed are useful for a wide range of applications, including thermal ink jet printheads and other MOS circuit applications.

While the invention has been particularly shown and described with reference to the preferred embodiments thereof, it will be understood by those skilled in the art that various changes in form and details may be made without departing from the spirit and scope of the invention.

What is claimed is:

1. A thermal inkjet print head comprising:

a) a substrate comprising a field oxide region and a power transistor thereon, said power transistor comprising a source region, a drain region and a gate electrode, said substrate having an ink well region;

b) a resistive layer over said ink well region, and over said source and drain regions; said resistive layer forming a resistor over said ink well region, said resistive layer formed of two layers of material selected from the group consisting of: a titanium layer under a titanium nitride layer, and a titanium layer under a tungsten nitride layer;

c) a first metal layer over said resistive layer; said first metal layer having an opening over said ink well region;

d) a passivation layer over said first metal layer; and said passivation layer on said resistive layer over said ink well region;

e) a second metal layer over said passivation layer over said ink well region; and f) a film over a surface of said substrate, said film having an ink well opening over said ink well region.

2. The thermal inkjet printhead of claim 1 which further includes a nozzle plate comprised of silicon carbide having an orifice in communication with said ink well opening.

3. The thermal inkjet printhead of claim 1 wherein said resistive layer is formed using a process selected from the group consisting of chemical vapor deposition and sputtering processes.

4. The thermal inkjet printhead of claim 1 wherein said first metal layer has a thickness in a range of between about 5000 and 20,000 Å.

5. The thermal inkjet printhead of claim 1 wherein said resistive layer is formed of said titanium layer under said titanium nitride layer.

6. The thermal inkjet printhead of claim 1 wherein said resistive layer is formed of said titanium layer under said tungsten nitride layer.

7. The thermal inkjet printhead of claim 1 wherein said resistive layer is formed of: said titanium layer under said titanium nitride layer; said titanium nitride layer stuffed with Oxygen.

8. The thermal inkjet printhead of claim 1 wherein said resistive layer is formed over said source and drain regions and said first metal layer is formed over said resistive layer over said source and drain regions whereby said first metal layer does not touch said substrate.

9. A thermal inkjet print head comprising:

a) a substrate comprising a field oxide region and a power transistor thereon, said power transistor comprising a source region, a drain region and a gate electrode, said substrate having an ink well region;

b) a resistive layer over said ink well region, and over said source and drain regions; said resistive layer forming a resistor over said ink well region, whereby said resistive layer functions as a metal barrier layer over said source and drain regions, said resistive layer is formed of two layers of material selected from the group consisting of: a titanium layer under a titanium nitride layer, and a titanium layer under a tungsten nitride layer;

c) a first metal layer over said resistive layer; said first metal layer having an opening over said ink well region whereby said first metal layer does not touch said substrate;

d) a passivation layer over said first metal layer; and said passivation layer on said resistive layer over said ink well region;

e) a second metal layer over said passivation layer over said ink well region; and f) a film over said substrate, said film having an ink well opening over said ink well region.

10. The thermal inkjet print head of claim 9 which further comprises said resistive layer is composed of said titanium layer under said tungsten nitride layer, said titanium layer having a thickness in a range of between about 200 and 600 Å and said tungsten nitride layer having a thickness in a range of between about 400 and 2000 Å.

11. The thermal inkjet print head of claim 9 wherein said resistive layer is composed of said Titanium layer under said titanium nitride layer, and said titanium layer has a thickness in a range of between about 200 and 600 Å, and said titanium nitride layer has a thickness between about 400 and 2000 Å.

12. The thermal inkjet printhead of claim 9 wherein said resistive layer is formed of: said titanium layer under said titanium nitride layer; said titanium nitride layer stuffed with Oxygen.

* * * * *